US012715551B2

(12) United States Patent
Trewern et al.

(10) Patent No.: US 12,715,551 B2
(45) Date of Patent: Aug. 25, 2026

(54) USER INTERFACE FOR POWERED WATERCRAFT

(71) Applicant: FLITEBOARD PTY LTD, Byron Bay (AU)

(72) Inventors: David Trewern, Byron Bay (AU); James Burns, Byron Bay (AU); Glenn Foster, Byron Bay (AU)

(73) Assignee: FLITEBOARD PTY LTD, New South Wales (AU)

( * ) Notice: Subject to any disclaimer, the term of this patent is extended or adjusted under 35 U.S.C. 154(b) by 425 days.

(21) Appl. No.: 18/546,890

(22) PCT Filed: Feb. 17, 2022

(86) PCT No.: PCT/AU2022/050113
§ 371 (c)(1),
(2) Date: Aug. 17, 2023

(87) PCT Pub. No.: WO2022/174295
PCT Pub. Date: Aug. 25, 2022

(65) Prior Publication Data

US 2024/0132181 A1 Apr. 25, 2024
US 2024/0227987 A9 Jul. 11, 2024

(30) Foreign Application Priority Data

Feb. 19, 2021 (AU) ..... 2021900440

(51) Int. Cl.
*B63B 32/10* (2020.01)
*B63B 32/66* (2020.01)
(Continued)

(52) U.S. Cl.
CPC ..... *B63B 32/10* (2020.02); *B63B 32/66* (2020.02); *B63B 32/70* (2020.02); *B63B 32/77* (2020.02); *B63H 21/17* (2013.01)

(58) Field of Classification Search
CPC ..... B63B 32/10; B63B 32/66; B63B 32/70; B63B 32/77; B63B 34/40; B63B 1/24; B63H 21/17
See application file for complete search history.

(56) References Cited

U.S. PATENT DOCUMENTS 7,232,243 B1 * 6/2007 Nassif ..... A63C 5/06 362/249.05
8,469,569 B1 * 6/2013 Tunnicliffe ..... A63C 17/015 362/545

(Continued)

FOREIGN PATENT DOCUMENTS

WO 2019/104378 A1 6/2019
WO 2019/104379 A1 6/2019

OTHER PUBLICATIONS

International Search Report for PCT/AU2022/050113 mailed May 3, 2022, 4 pages.

(Continued)

*Primary Examiner* — Brian P Wolcott
(74) *Attorney, Agent, or Firm* — NIXON & VANDERHYE

(57) ABSTRACT

An electric powered watercraft includes a board, a battery, a motor, and a controller with an output, wherein an optical waveguide communicates light from the output to a dock of the board.

18 Claims, 3 Drawing Sheets

(51) Int. Cl.

| | |
|---|---|
| ***B63B 32/70*** | (2020.01) |
| ***B63B 32/77*** | (2020.01) |
| ***B63H 21/17*** | (2006.01) |

(56) References Cited

U.S. PATENT DOCUMENTS

| | | | | |
|---|---|---|---|---|
| 10,647,392 | B2 * | 5/2020 | Trewern | B63B 32/10 |
| 2009/0165690 | A1 * | 7/2009 | Walworth | B63H 11/04 440/38 |
| 2020/0079479 | A1 | 3/2020 | Derrah | |

OTHER PUBLICATIONS

Written Opinion of the ISA for PCT/AU2022/050113 mailed May 3, 2022, 6 pages.

* cited by examiner

USER INTERFACE FOR POWERED WATERCRAFT

CROSS-REFERENCE TO RELATED APPLICATIONS

This application is the U.S. national phase of International Application No. PCT/AU2022/050113 filed Feb. 17, 2022, which designated the U.S. and claims priority to AU Provisional Patent Application No. 2021900440 filed Feb. 19, 2021, the entire contents of each of which are hereby incorporated by reference.

BACKGROUND OF THE INVENTION

The present invention generally relates to powered watercraft, and in particular to apparatus for providing information to a user of a craft or board that has an electric motor and battery.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Recent developments in battery technology have started to make electric watercraft more practical, where high power requirements and the size and weight of batteries previously prevented this. One particular form of watercraft that is growing in popularity is the electric surfboard, created by the attachment of a motor to a surfboard, with the battery typically housed within the board.

Another example is an electric hydrofoil surfboard, which includes an electric motor and a hydrofoil in combination, where the hydrofoil elevates the board clear of the water when under power from the motor, reducing drag and providing high speed travel over the water. Many components required for operation of the motor may be housed in the board, such as batteries and/or control circuitry. These components must then be connected to the motor at the lower end of the mast by wires that are routed internally down the mast.

Control of the motor may be achieved via a hand controller communicating wirelessly with the control circuitry located in the board. Information can also be conveyed back to the user via the hand controller, or by lights on the board or motor.

The combination of water and electricity, together with large changes in temperature and heat generated by electrical components, means that adequate sealing is difficult but very important in both conventional and hydrofoil watercraft. Adding to this complexity, it is often desirable for the watercraft to be easily disassembled regularly for transport or for maintenance, but to still have adequate sealing every time it is assembled again for use. All the while, users still demand such craft to remain as affordable as possible.

SUMMARY OF THE PRESENT INVENTION

In one broad form of the invention, there is provided an electric powered watercraft, comprising a board, a battery, a motor, and a controller with an output, wherein an optical waveguide communicates light from the output to a deck of the board.

In an embodiment, the output is an LED.

In an embodiment, the output is a plurality of LEDs.

In an embodiment, the deck comprises one or more markings that correspond with one or more of the LEDs.

In an embodiment, the output is a display.

In an embodiment, a lens is located between the output and the optical waveguide.

In an embodiment, the lens forms part of a housing of the controller.

In an embodiment, the lens is shaped to magnify light from the output.

In an embodiment, a deck lens is located at the end of the optical waveguide where it meets the deck.

In an embodiment, the optical waveguide comprises a plurality of optical fibres.

In an embodiment, the optical waveguide comprises one or more light pipes.

In an embodiment, the optical waveguide comprises a board mounted lens.

In an embodiment, the output is angled relative to the deck.

In an embodiment, the optical waveguide comprises a bend or curve.

In an embodiment, the optical waveguide extends to a part of the deck proximal to a forward end of the board.

In an embodiment, the controller is removable from the board.

In an embodiment, the watercraft further comprises a hydrofoil.

In an embodiment, the hydrofoil and the motor are connected to a mast that extends from the board.

In an embodiment, the controller is fixed to an upper end of the mast.

In an embodiment, the controller can be coupled to the board by inserting at least a portion of the controller located at the upper end of the mast into a socket of the board.

In an embodiment, the controller is further configured to exchange information wirelessly with an input device.

In an embodiment, there is no electrical connection between the controller and the board.

In an embodiment, the board does not contain any electrical component.

It will be appreciated that the broad forms of the invention and their respective features can be used in conjunction and/or independently, and reference to separate broad forms is not intended to be limiting. Furthermore, it will be appreciated that features of the method can be performed using the system or apparatus and that features of the system or apparatus can be implemented using the method.

BRIEF DESCRIPTION OF THE DRAWINGS

Various examples and embodiments of the present invention will now be described with reference to the accompanying drawings, in which:—

DETAILED DESCRIPTION OF THE PREFERRED EMBODIMENTS

Figure 1:
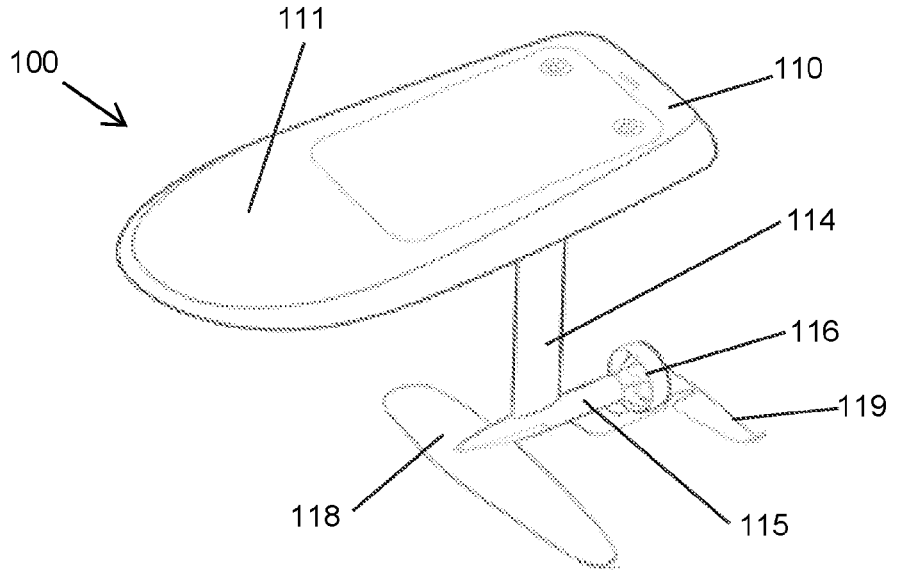
FIG. 1 is an isometric view of a watercraft according to an embodiment of the invention.

The following modes, given by way of example only, are described in order to provide a more precise understanding of the subject matter of a preferred embodiment or embodiments.

In the Figures, incorporated to illustrate features of an example embodiment, like reference numerals are used to identify like parts throughout the Figures.

An example of a watercraft according to an embodiment of the invention will now be described. The watercraft is electric powered and includes a board, a battery, and a motor. A controller manages operation of the board and has an output that can be used to convey information to a user.

As the controller is typically not visible by a user during operation of the watercraft, an optical waveguide is used to communicate light from the output to a deck of the board. In this way, the user can see information from the output during use, such as when lying or standing on the board.

Throughout this specification, unless otherwise indicated the term "board" is used in a broad sense and is intended to include any suitable form of flotation device. For example, the board may be a rigid structure made from fibreglass, carbon fibre, or other similar materials. It may or may not include a foam or other type of core, similar to a surfboard for example. Alternatively, the board may be softer, such as made primarily from a rigid foam or similar. In still another example, the board may be inflatable or collapsible in some other way, so that it can take a rigid or at least semi-rigid form during use, but can be deflated or otherwise packed down for transport.

The watercraft as described is advantageous by permitting use of fewer, simpler, and/or lighter components, potentially reducing cost and/or minimising weight for better performance. For example, rather than having a separate display mounted in the deck that requires cabling and one or more connectors for accessing power and communicating with the controller, the board can be made simpler, lighter and/or cheaper, as these components are no longer required.

The reduction in cabling and connections may also help to ensure that all necessary parts remain watertight to reduce the chance of any malfunction and/or injury. That is, by having more of the electronics being contained within a housing of the controller, this could allow for modules or components to be removed and for the watercraft to be packed down for transport, but for each module or component to be self-contained and data connections reduced or removed. This can limit the necessary seals that could potentially wear over time or cause problems if not fitted exactly correctly on a particular occasion.

Some other example embodiments of a watercraft will now be described.

In an embodiment, the output may be an LED. This LED can report status, operation and/or errors by flashing, displaying solid on/off and/or different colours to the user. For example, red colour or flashing may indicate an error, while green may indicate that the board is activated and ready for use.

In another example embodiment, the output may be a plurality of LEDs. Again, these can report various information to the user, with the possibility of more options. For example, each LED may be associated with a particular function of the watercraft, or the LEDs may be arranged in a line to indicate a quantity such as a battery charge level, available range or throttle percentage. In one example, there may also be markings on the deck to correspond with particular LEDs to assist the user in understanding the information being displayed.

In yet another example, the output is a display. For example, the output may be any known display type that has a significant number of pixels, such as an OLED, AMOLED, backlit LCD, TFT LCD, or PDP display.

In an embodiment, a lens may be located between the output and the optical waveguide. The LEDs or display used for the output will typically not be naturally configured to interact efficiently or correctly with the optical waveguide, which could otherwise result in the light being conveyed to the deck being unclear or dull. Therefore, the lens can ensure that the light being emitted by the output gets efficiently and accurately conveyed to the deck for viewing by the user.

In one more specific example, the lens may form part of a housing of the controller. That is, the controller may include control circuitry and the output mounted within a housing. This housing may substantially surround the components of the controller, with a section of the housing that overlays the output being formed by the lens. In this way, the output is protected by being inside the housing while still being capable of transmitting light to the optical waveguide.

In some examples, the lens may be shaped to magnify light from the output. For example, the output could be small to allow it to be more easily packaged with the controller, but the light ultimately displayed to the user could be much larger so that it is easily seen even while standing on the board. In this or other examples, there may also be a deck lens located at the end of the optical waveguide where it meets the deck. This deck lens may or may not also magnify the light, or may simply correct the light conveyed from the optical waveguide so that it is more easily seen by the user.

The optical waveguide may be any suitable structure that is capable of conveying optical waves from the output to the deck. In one example, the optical waveguide may be an optical fibre or a plurality of optical fibres. It will be appreciated, however, that other forms of optical waveguide may also be possible, such as a single light pipe in cases where the output is a single LED, or a plurality of light pipes in cases where the output is a plurality of LEDs. In another example, the optical waveguide may be a single board mounted lens or a plurality of lenses.

In an embodiment, the output may be angled relative to the deck. That is, rather than a plane of the output being parallel to a plane of the deck, there may be an angle, such as 10°, 20°, or 45°, for example. This could also mean that instead of the optical waveguide extending directly from the output to the deck at an angle of 90° relative to the deck, the optical waveguide may also extend at some other angle.

In these or other examples, the optical waveguide may have one or more bends or curves. For example, in cases where the output is angled relative to the deck, the optical waveguide may be shaped so that it is still normal to both the output and the deck at the locations where they each meet. This could even allow the output to be at the side of the controller, for example, where it may be angled at approximately 90° to the deck, yet still allow the optical waveguide to successfully connect the two.

In one example, the optical waveguide may extend to location of the board that is significantly separated from the controller. For example, the optical waveguide may extend to a part of the deck proximal to a forward end of the board, even if the controller is located towards a rear end of the board. This could be useful to allow the user to more easily see the information conveyed to the deck while riding the board.

In some embodiments, the controller may be removable from the board. There are various reasons why this may be desirable, such as disassembly of the watercraft for transport, or for servicing or replacement of components, for example. In these cases it is advantageous that the present invention reduces the need for cables and/or connectors.

The electronics are contained as part of the controller, so that the output can be simply removed as part of the controller. When the controller is returned, the display can simply align again with the optical waveguide without the need for any connectors. This may make the disassembly and reassembly simpler and also reduce the risk of damage or failure of waterproofing seals, for example.

In another example of the watercraft, the controller may be in a waterproof compartment. That is, appropriate seals are provided, for example, to ensure that during use of the watercraft it is not possible for water to reach the controller. In one specific example, there may even be an air gap located outside the controller. Regardless of whether there is an air gap or not, the prevention of water finding its way even to the outside of the controller is advantageous, because this avoids the risk of interference of the optical signal that water could potentially cause.

In one example, the watercraft may be in the form of an electric hydrofoil board. That is, the watercraft may further include a hydrofoil connected to the board by a mast. The motor may also be connected to the mast proximal to the hydrofoil, or the hydrofoil and motor may be connected to one another so that the hydrofoil is actually connected to the mast by the motor.

The hydrofoil and connected components could actually take a range of forms, provided it includes one or more components for providing lift, as well as necessary components for providing propulsion. For example, a hydrofoil module may have an integrated motor and wings similar to the present Applicant's earlier design as described in publication number WO/2019/104378. In this way, the wings are not connected directly to the mast, but rather the wings are connected to the motor housing, which in turn is connected to the mast. Alternatively, the hydrofoil module may take a different form, such as some other known designs where a mast has wings mounted at one location and a motor mounted at a separate location.

The controller may in fact be fixed to an upper end of the mast, so that removal of the controller in turn also causes the mast, motor and hydrofoil to be removed from the board. For example, the controller may be coupled to the board by inserting at least a portion of the controller located at the upper end of the mast into a socket of the board, similar to that described in the present Applicant's earlier design published as WO/2019/104379. This could allow very quick and simple assembly and disassembly, while having sufficient strength to withstand the high forces experienced by this connection during use. This connection can also allow for seals to be incorporated relatively easily, to ensure electrical connections are not exposed to water.

In another example of a watercraft, the controller is further configured to exchange information wirelessly with a hand controller. This may be achieved using any suitable wireless protocol and communicators, such as Bluetooth, Bluetooth Low Energy (BLE), or the like.

The hand controller can function as a user input device for the watercraft, such as by receiving an input through a button or trigger and sending a signal to the controller to choose the level of thrust to be produced by the motor, for example. The hand controller may also be sent information from the controller for display to a user, such as a charge level of the battery, temperature, speed, and any other relevant parameters. This may be the same or different information that is displayed on the deck of the board.

In some examples of the watercraft, there may be no electrical connection between the controller and the board. That is, rather than the controller being connected to wiring in the board, with this wiring in turn being connected to other components such as the battery, instead the battery and controller may be directly connected to each other. Additionally, the controller may not have any other electrical connections, including no data connections for displays or separate wiring for charging the battery, for example.

In one particular example of a watercraft, all of the electrical components may be located in the controller, the battery, and/or the hand controller. That is, the board itself may not contain any electrical components at all. Such a system allows the board to be as cheap, simple, and lightweight as possible. The present invention is therefore advantageous, because it still allows for information to be displayed on the deck, without the use of electronics in the board and even with the controller located away from the deck.

An example embodiment of a watercraft 100 will now be described with reference to the Figures.

Referring to FIG. 1, the watercraft 100 has a board 110 with a deck 111 that is suitable for a user to lie or stand on when in use. A mast 114 extends from a lower surface of the board 110 and a motor 115 with propeller 116 is connected to a lower end of the mast 114. A main hydrofoil wing 118 and a tail wing 119 are each connected to a body of the motor 115.

Figure 2:
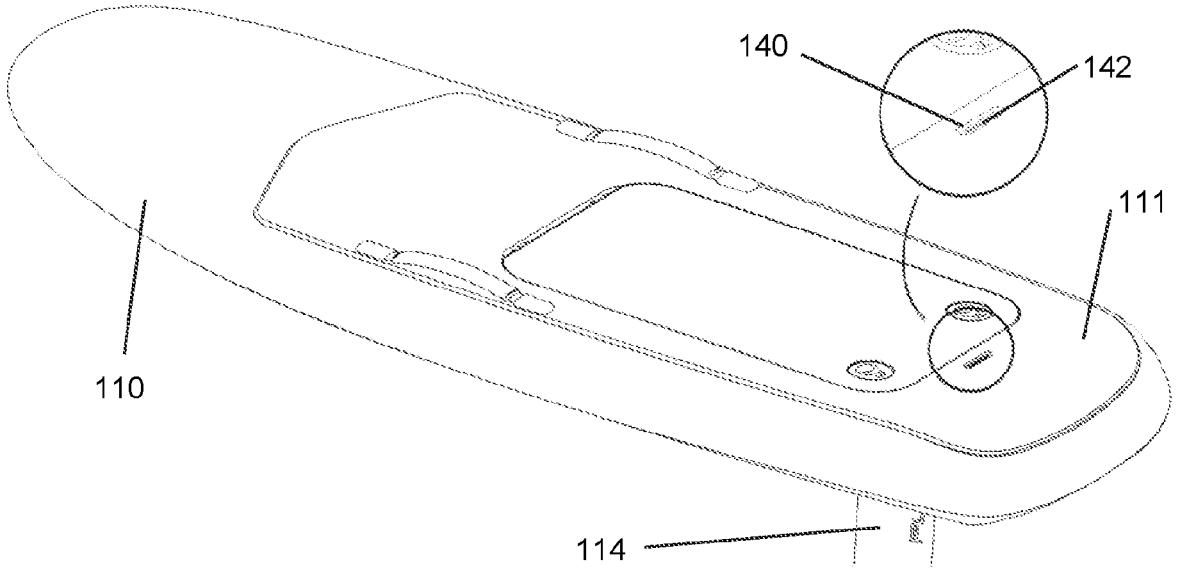
FIG. 2 is a perspective view of the board of the watercraft from FIG. 1.

Referring now to FIG. 2, the watercraft 100 has an opening 140 through which optical waveguides 142 can be seen. This opening 140 has a transparent cover to prevent damage or water ingress to the optical waveguides 142.

It will be appreciated that in some alternative embodiments it may be desirable for this cover to be in the form of a lens and/or to be made from a different material, such as glass.

Figure 3:
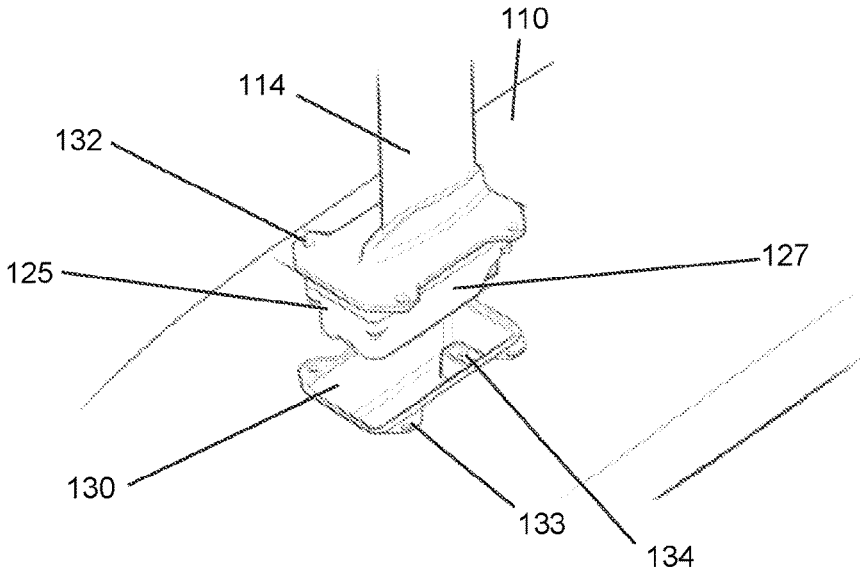
FIG. 3 is an isometric view of an underside of the watercraft from FIG. 1 with a controller removed from the board.

Referring to FIG. 3, the controller 125 is shown removed from the board 110. In this embodiment, the controller 125 is fixed to the upper end of the mast 114 and can be inserted into a socket 130 of the board 110. Wiring extends along the inside of the mast 114 to connect control circuitry inside the housing 127 to the motor 115 that is located at the opposite end of the mast 114.

A flange 132 is configured to mate with a rebate 133 in the board 110 and secured in place using fasteners (not shown). The flange 132 forms a watertight seal with the rebate 133 to ensure that no water can enter a space between the housing 127 and the socket 130, maintaining a small air gap between the two. The mast 114 and the flange 132 are constructed from aluminium, while the remainder of the housing 127 is constructed from a plastic.

Once the controller 125 is inserted into the socket 130, an electrical connection provides power from the battery that is located inside the board 110. In the embodiment of FIG. 3, this electrical connection includes two pins on the controller 125 which are received in respective apertures 134 in the socket 130. These two conduction paths allow power to be transmitted. However, a preferred alternative embodiment uses leads or cables for this electrical connection, allowing the battery to be connected directly to the controller 125, thereby avoiding the electrical connection to the board 110.

Figure 4:
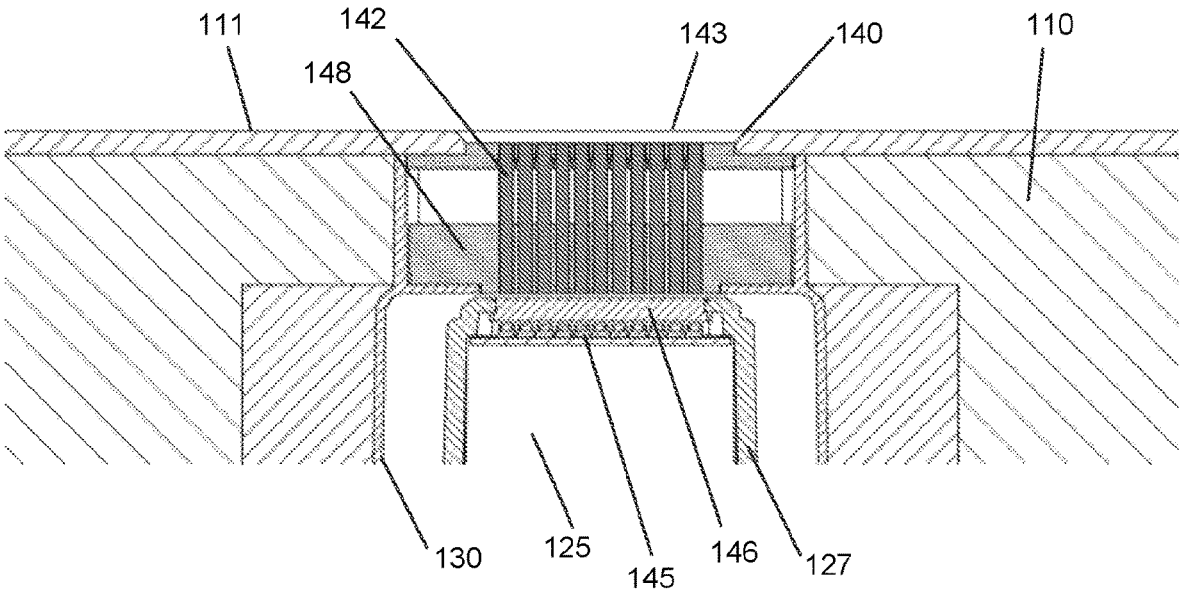
FIG. 4 is cross sectional end view of a portion of the controller and the board of the watercraft from FIG. 1.

Referring to FIG. 4, an upper portion of the controller 125 is shown fitted in the socket 130. The controller 125 includes an output 145 in the form of a number of LEDs. This output 145 is covered by a lens 146 that forms part of the housing 127. When the controller 125 is positioned in the socket 130 as shown, the lens is located adjacent an optical waveguide in the form of a series of light pipes 142. The light pipes 142 extend from the socket 130 to the deck 111 of the board 110, where they can be viewed through the cover 143. The light pipes 142 are held in place by a holder 148.

The controller 125 also includes the relevant components for allowing the watercraft 100 to function, including a microprocessor, a memory, an input/output device in the form of one or more wireless communication devices to exchange instructions with an input device and/or battery, and a logic level motor controller, interconnected by a bus. These components function together to allow the controller to perform tasks including battery management, motor operation, and data output to be displayed to a user.

The nature of the controller and in particular the physical form factor of the device, as well as the components used, can vary depending on the preferred implementation. For example, the microprocessor and communication device can be formed from a custom integrated circuit, such as a Bluetooth system on a chip (SOC), coupled to, or including an integrated antenna and other optional components, such as the memory.

The controller 125 is preferably configured to communicate with an input device in the form of a hand controller (not shown). The hand controller is operated by the user and can be used to control the motor speed and to relay data to the user, such as diagnostic and performance information. This may be the same or different information that is displayed on the deck of the board.

By providing a direct electrical connection between the battery and the controller 125, the use of the optical waveguides 142 to transfer information from the output 145 means that the board 110 does not require any electrical components at all. In this way, the manufacture of the board can be greatly simplified and the cost of the board significantly reduced. The reduced complexity can also lower the risk of malfunction, such as may be caused by a water seal failing, for example.

The alternative to the present invention for displaying information on the deck would be to build electronics into the board. However, this can be problematic, expensive, and prone to leaks and issues. Therefore, tunnelling light through light pipes as described above allows electronics to be kept out of the board. This means that data connectors or wiring are not needed, ensuring the board is not a failure point for electronics.

While the embodiment described uses a linear array of LEDs for the output, it is anticipated that the same or similar technique could be used with a two dimensional array or a more complex screen. In this way, it may be possible to display messages, images, or even make a screen on the board that does not rely upon electronics in the board itself.

Figure 5:
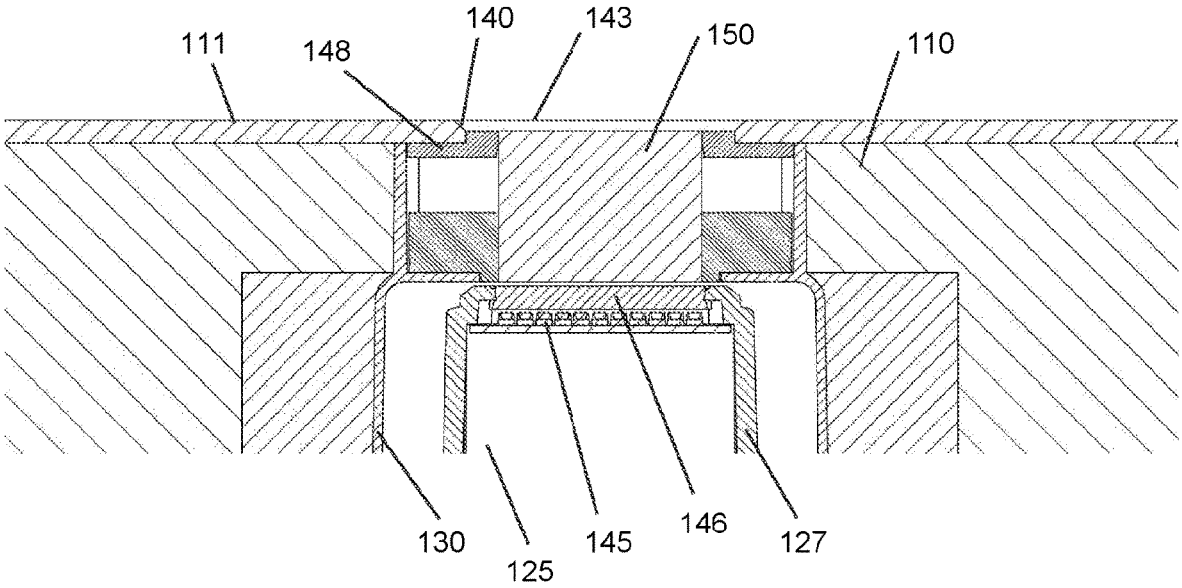
FIG. 5 is a cross sectional end view of a portion of the controller and the board of an alternative embodiment of a watercraft.

Referring to FIG. 5, an alternative embodiment of the invention is shown. Similar to the previous embodiment, an upper portion of the controller 125 is shown fitted in the socket 130. The controller 125 includes an output 145 in the form of a number of LEDs. This output 145 is covered by a first lens 146 that forms part of the housing 127.

When the controller 125 is positioned in the socket 130 as shown, the first lens 146 is located adjacent an optical waveguide, which is now in the form of a second lens 150. The second lens 150 extends from the socket 130 to the deck 111 of the board 110, where it can be viewed through the cover 143. The lens 150 is held in place by a holder 148.

It will be appreciated that either of the first lens 146 and/or second lens 150 may take a variety of forms. For example, one or both of the lenses 146, 150 may magnify the light from the output 145. Alternatively, one or both of the lenses 146, 150 may more akin to a simple cover, wherein the light is distorted as little as possible.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above" and "below" and the like are used as words of convenience to provide reference points and are not to be construed as limiting terms Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers. As used herein and unless otherwise stated, the term "approximately" means±20%.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. An electric powered watercraft, comprising:

a board including a deck and a socket;

a battery disposed within the board;

a motor configured to operate the watercraft;

a controller configured to control the motor, the controller being electrically connected to the battery, the controller with an output that includes at least one light-emitting diode (LED); and an optical waveguide extending through the board from the socket to the deck, the optical waveguide communicating light from the at least one LED to the deck of the board.

2. The watercraft according to claim 1, wherein the deck comprises one or more markings that correspond with one or more of the at least one LED.

3. The watercraft according claim 1, further comprising a lens disposed between the output and the optical waveguide.

4. The watercraft according to claim 3, wherein the controller includes a housing, and the lens forms part of the housing of the controller.

5. The watercraft according to claim 3, wherein the lens is shaped to magnify light from the output.

6. The watercraft according to claim 1, further comprising a deck lens disposed at an end of the optical waveguide where the optical waveguide meets the deck.

7. The watercraft according to claim 1, wherein the optical waveguide comprises a plurality of optical fibers.

8. The watercraft according to claim 1, wherein the optical waveguide comprises one or more light pipes.

9. The watercraft according to claim 1, wherein the optical waveguide comprises a board-mounted lens.

10. The watercraft according to claim 1, wherein the output of the controller is angled relative to the deck.

11. The watercraft according claim 1, wherein the optical waveguide comprises a bend or a curve.

12. The watercraft according to claim 1, wherein the optical waveguide extends to a part of the deck proximal to a forward end of the board.

13. The watercraft according to claim 1, wherein the controller is removable from the board.

14. The watercraft according to claim 1, further comprising:

a hydrofoil; and a mast that extends from the board, wherein the hydrofoil and the motor are connected to the mast that extends from the board.

15. The watercraft according to claim 14, wherein the controller is fixed to an upper end of the mast, the controller being configured to be disposed at the upper end of the mast, the controller being configured to be inserted into the socket of the board to couple the controller to the board.

16. The watercraft according to claim 1, wherein the controller is configured to exchange information wirelessly with an input device.

17. The watercraft according to claim 1, wherein there is no electrical connection between the controller and the board.

18. The watercraft according to claim 1, wherein the controller is configured to be disposed within the socket of the board.

* * * * *